US005113847A

United States Patent [19]

Holzworth

[11] Patent Number: 5,113,847

[45] Date of Patent: May 19, 1992

[54] DEVICE FOR STIMULATING INTRAMUSCULAR FLUID PRESSURE

[76] Inventor: Dwight D. Holzworth, 1587 Rosehill Rd., Reynoldsburg, Ohio 43068

[21] Appl. No.: 647,942

[22] Filed: Jan. 30, 1991

[51] Int. Cl.[5] ..... A61H 7/00

[52] U.S. Cl. ..... 128/24 R; 606/189; 606/204; 128/60; 128/67; 128/907

[58] Field of Search ..... 128/24 R, 54, 60, 61, 128/64, 67–69, 845, 907; 606/189, 204; 272/67, 68, 76; 81/19, 20, 22, 25

[56] References Cited

U.S. PATENT DOCUMENTS

| | | | |
|---|---|---|---|
| 723,735 | 3/1903 | Schillberg | 128/67 X |
| 1,965,861 | 7/1934 | Schneider | 128/67 X |
| 2,204,789 | 6/1940 | Bredow | 128/54 X |
| 3,496,573 | 2/1970 | Kuchar et al. | 272/68 |
| 3,750,654 | 8/1973 | Shiu | 128/68 X |
| 3,937,468 | 2/1976 | Conde, Sr. | 272/76 X |
| 4,085,738 | 4/1978 | Kodera | 128/70 X |
| 4,479,495 | 10/1984 | Isaacson | 606/204 |
| 4,520,798 | 6/1985 | Lewis | 128/60 X |
| 4,549,536 | 10/1985 | Varjabedian | 606/189 X |
| 4,648,387 | 3/1987 | Simmons | 128/67 X |
| 4,712,539 | 12/1987 | Kim | 128/67 X |
| 4,716,898 | 1/1988 | Chauve et al. | 606/204 |
| 4,745,909 | 5/1988 | Pelton et al. | 128/67 X |
| 4,745,910 | 5/1988 | Day et al. | 128/67 X |
| 4,848,357 | 7/1989 | Wong et al. | 128/907 X |
| 4,982,950 | 1/1991 | Petrosky | 272/68 X |

*Primary Examiner*—Richard J. Apley
*Assistant Examiner*—Linda C. M. Dvorak
*Attorney, Agent, or Firm*—Biebel & French

[57] ABSTRACT

A device for stimulating intramuscular fluid pressure is disclosed having a first tool component having a base member with top and bottom, and a cylindrical member. The cylindrical member is wrapped about the base member intermediate the top and bottom and has an outer sidewall surface. The first tool component also has a wedge-shaped member with a front face, a rear face, and a bottom surface. The wedge-shaped member is attached to the base member intermediate the top and the cylindrical member. The device also has a second tool component, having a second base member with a top, a bottom, and a cylindrical member wrapped about the second base member inermediate the second base member top and bottom.

20 Claims, 4 Drawing Sheets

DEVICE FOR STIMULATING INTRAMUSCULAR FLUID PRESSURE

BACKGROUND OF THE INVENTION

The present invention relates to a therapuetic apparatus, and more particularly to a device for stimulating intramuscular fluid pressure in order to provide relief of pain or other discomfort. Certain types of pain and other bodily discomfort do not respond well to medication. Alternative methods of treatment such as acupuncture and acupressure have their proponents. The art of acupressure is similar to the art of acupuncture, except that no needles are used in administering the treatment. Specifically, acupressure is the application of pressure to various body areas to affect nerve junctures within the body. The nerve junctures affected in order to provide temporary relief of pain or other bodily discomfort are often associated with the sciatic nerve, which is sensory and motor nerve originating in the sacral plexus and running through the pelvis and upper leg.

Many different devices have been advanced as optimal acupressure tools. Examples of such devices are the bodo, a device with the handle having thereon a single knob-like probe with an operating surface of approximately less than 1 square inch. This device is used by therapists and self-massage shiatsu technique to access small places typically inaccessible to the entire palm of the hand, the elbow, or other parts of the anatomy which traditionally have been utilized to accomplish massage. Another device is the apparatus disclosed in U.S. Pat. No. 4,520,798 to Lewis for a self accupressure method. Still another is the massage means disclosed in the U.S. Pat. No. 4,493,315 to Iwahashi. This particular massage means discloses a hand-held device having an intermediate stick having one end joined to the right hand bar and the other end joined to one end of the left hand bar, the center portion of the intermediate bar being made of resilient material and a pair of spherical pressing members disposed at both ends with respect to the center portion of the intermediate bar with a space provided therebetween in the longitudinal direction of the intermediate bar.

Chronic muscle pain has been shown to be related to specific regions of the body known as "trigger points" or "trigger zones". Although these terms were used as early as 1936 in the American Journal of Medical Science, it was not until 1938 that an article in the Journal of the American Association associated the pain phenomena with musculature.

Pathogenic muscular tension has negative affect on blood circulation and fluid pressure within the body. For example, muscle tension squeezes the blood vessels, clamping them closed and consequently inhibiting desired blood flow. With respect to the arteries, this tension reduces the flow of oxygenated blood through the tissues, a condition known as ischemia. This tension also results in the burning of food stuffs in the absence of adequate oxygen, a condition known as anaerobic metabolism. This in turn results in the production of lower amounts of energy due to incomplete combustion of glucose and the formation of lactic acid which affects the chemical balance in muscle tissue. The increased presence of lactic acid and its byproducts most importantly increase the acidity by decreasing the pH within the muscle tissues, a condition known as acidosis. The presence of increased levels of lactic acid stimulate the nociceptor or pain nerves resulting in a deep pain which spreads throughout the muscle tissue.

The tension affects on arteries also present increased resistance to blood flow thereby directly and indirectly contributing to an increase in blood pressure. Similarly, tension affects the blood flow through veins, since the thin and pliable vessels of venous circulation are extremely susceptible to occlusive pressures. The tension also increases resistance to flow of wastes such as lactic acids. Additionally, back pressure due to resistance to flow prevents fluids from leaving muscles, thereby resulting in myositis, increased fluid content in muscle tissue spaces.

As the muscles continue to fill with incompressible fluids, the internal muscle fluid pressure known as the hydrostatic pressure, rises. This fluid pressure results in afferent signals to the central nervous system that the muscle is experiencing an internal stretch, which is reponded to by motor neurons in the anterior horn that transmit signals to increase the contractions of the tensing muscle to counter the perceived stretching of the muscle fibers, a condition known as a stretch-reflex or myotatic reflex. This resultant involuntary muscle contraction continues and results in further increased muscle tension. The fluids which are in the muscles become locked into the tissue as the muscle further contracts. Muscle contraction forces fluids into paths of least resistance, especially into fascial and tendinous tissue. This condition is known as myofascitis. Fluid becomes sequestered in these relatively fibrous tissues that have little metabolic activity and diminshed channels available for circulation.

The pockets of fluid encourage focal myospasm and are associated with trigger points. Such trigger points are unrelieved by conventional therapy devices since such devices do not adequately relieve the fluid pressure in intramusclar tissue spaces.

The points from which pain is sensed is unclear, but these fluid sequestrations are palpable. Applying deep digital pressure to these "trigger points" may have relieving or aggravating effects upon the strength duration and/or character of pain perceived. It is the published opinion of lending medical researchers of myofascial trigger points that there are only three therapies that will defuse the trigger point: (1) spray with a vapocoolent spray and stretch the muscle, (2) inject the fluid/spasm nidus with a solution containing procaine, and (3) external pressure applied to the muscle (ischemic compression). See for example the article authored by Dr. Janet Travell entitled "Myofascial Origins Of Low Back Pain", *Post Graduate Medicine*, Feb. 1983.

Myofascial tension, or tension within the muscles and their coatings are known to pinch off channels of circulation, either by direct pressure or stretch. Lactic acidosis and a large group of other autotoxins result in nerves becoming more excited. The acidic and toxic irritation of muscle spindle afferents bombard the central nervous system with proprioceptive input and fire hyperirritable alpha type A motor efferents thereby increasing muscle contraction. Acidic, toxic and pathoreflexive irritation of gamma efferents increases the tension of muscle spindle intrafusal fibers, thereby increasing spindle sensitivity.

In addition to stagnating fluids presenting problems with focal sequestration, tension and acidosis, it also presents problems with intramuscular edema. The hydrostatic pressures associated with intramuscular edema, while relatively soft, help to perptuate a vicious cycle. Increased stiffness is a likely result of hypersensitive myotactic responses to congestive intramuscular edema. This stiffness is noted to occur following periods of rest where passive cyclic filling (congestion) and muscle tension summate as concommittants.

Prior to the 20th century, massage was the corner stone of pain therpy. However, beginning in the early 20th century medical professionals increasingly relied on the injection of analgesic at the location of the painful spot in the muscle.

Diffuse myofascial pain syndrome is defined by the International Association for the Study of Pain as a syndrome characterized by diffuse aching musculoskeletal pain and stiffness. Studies have attempted to define the basis for myofascial pain, with many of these studies focusing on the relationship between pain and trigger points or trigger zones. Unfortunately, as recently as 1989 Fishbain et al in article in the June issue of the Archives of Physical Medicine and Rehabilitation conceded that the etiology of diffuse/specific myofascial pain syndrome is unknown.

Prior acupressure devices have relied on the concept of addressing myofascial trigger point syndromes, as if specific trigger points are the source of all pain within the musculoskeleture. Consequently, they focused on point specific devices such as those which would have direct application to the Shiatzu mode of therapy.

Trigger point therapy art devices are specifically designed for "point by point" application to relieve fibrous adhesions, focal sequestrations of fluid and/or spasmodic neurological dysfunction. Thus, prior art therapy devices have consistently employed knob-like spherical or pointed contact surfaces. Such embodiments of prior art trigger point therapy devices do not address stimulation of intramuscular fluid reabsorption pressures, or "decongestive compression" therapy.

According to Starling's Law of capillary dynamics, decongestion of a muscle will occur when intramuscular hydrostatic pressure exceeds intesdtitial osmotic pressure+venous/lymphatic hydrostatis pressure. A fluid outpouring into circulation reduces intramuscular congestion. Increasing intramuscular fluid pressure is achieved simply by reducing the volume of the muscle/container. The volume of a muscle/container is reduced when the walls are compressed inward. The greater the reduction in volume of a muscle/container, the more pressure the container's contents possess. The decongestive compression process works much like squeezing fluid from a mop where greater pressure applied yields a greater outpouring of fluid.

Incremental pressures applied using prior art are distributed over a small area, such that the pounds per square inch (PSI) are relatively elevated. But since soft muscle tissue can only tolerate so many PSI's before tissue damage and pain occur. Therefore, while large amounts of PSI pressure are generated by the small contact surface areas of prior art, only a fraction of the potential pressures are physically tolerable.

It is thus apparent that the need exists for na improved device for stimulating intramuscular fluid pressure or the like which provides relief from pain or other discomfort beyond that attainable through the use of prior art devices and methodology of use.

SUMMARY OF THE INVENTION

The problems associated with prior acupressure related devices are overcome in accordance with the present invention by the providing of a device having a base member and a wedge-shaped member attached intermediate the top and bottom of the base member. This wedge-shaped member has a front face and a bottom surface which preferably is detachably secured to the base member, such that the orientation of the wedge may be inverted. Between the wedge-shaped member and the bottom of the base member is a cylindrical member wrapped about the base member, with this cylindrical member having an outer sidewall surface.

This base meber and wedge-shaped member comprise a first tool component of the invention. A second tool component of the invention comprises a second base member wrapped about similarly to the other base member and having an outer sidewall surface with exposed portions of the second base member at opposite ends of this second tool component. The first tool component being attached to the second tool component by means of a cord.

The presence of apertures at the top and the bottom of the first tool component permit the cord of the second tool component to be secured to either end of that component of the invention which includes the wedge-shaped member.

It is the primary object of the present invention to provide a device for stimulating intramuscular fluid pressure which is conveniently and inexpensively formed and which is easy to use.

It is another object of the present invention to provide a device for stimulating intramuscular fluid pressure which addresses pain in a number of areas of the body, not necessarily confined to recognized trigger points.

Still another object of the present invention is to provide a device for stimulating intramuscular fluid pressure which would permit an individual to address myofascial pain or other muscle discomfort without the necessity of having such treatment administered by a medical professional.

Other objects and advantages of the invention will be apparent from the following description, the accompanying drawings and the appended claims.

DETAILED DESCRIPTION OF THE INVENTION

Figure 1:
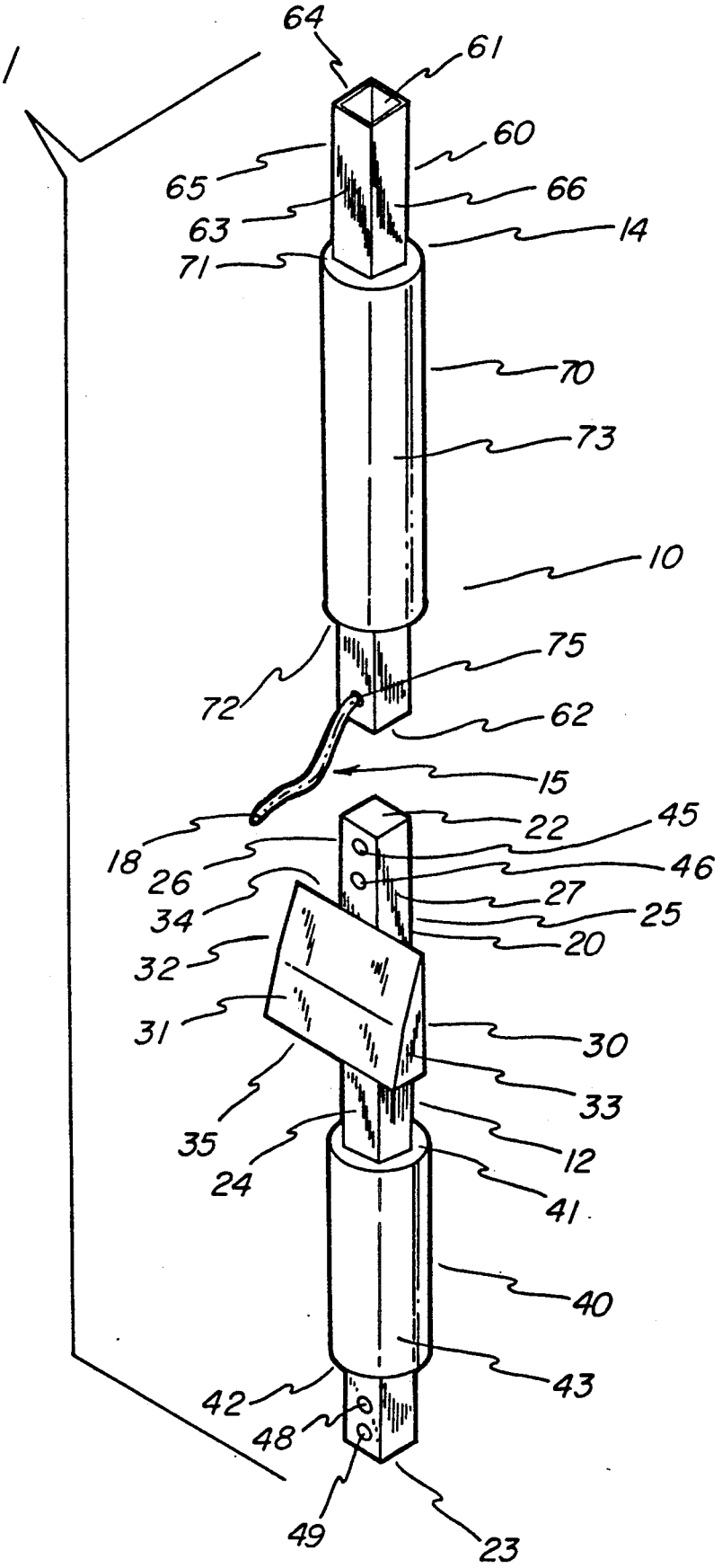
FIG. 1 is a perspective view of a device in accordance with the present invention.

Having reference to the drawings, attention is directed first to FIG. 1 which discloses a perspective view of the individual components of the invention with the device for stimulating intramuscular fluid pressure being designated generally by the numeral 10. This tool 10 comprises a first tool component 12 and a second tool component 14 secured to one another by an attachment means such as a nylon cord 15, having tip 18.

The first tool component 12 features a base member 20 having a top 22, a bottom 23, a front 24, a rear 25, and side walls 26 and 27. Although the configuration of base member 20 could vary, the preferred embodiment features a rectangular base member having the front 24, rear 25 and sides 26 and 27 the same width, approximately 1".

Base member 20 has secured intermediate top 22 and bottom 23 but closer to top 22, a wedge-shaped member 30. The wedge-shaped member 30 includes a front face 31, sides 32 and 33, rear 34 and bottom 35. In the preferred embodiment of the invention the front face slopes downwardly from base member 20 towards bottom 35. Additionally, it should be appreciated that although sides 32 and 33 have been referenced, these portions of the wedge-shaped member may be defined as specific individual faces of this member, or may merely comprise portions of the front face 31 which constitutes the wedge.

Figure 3:
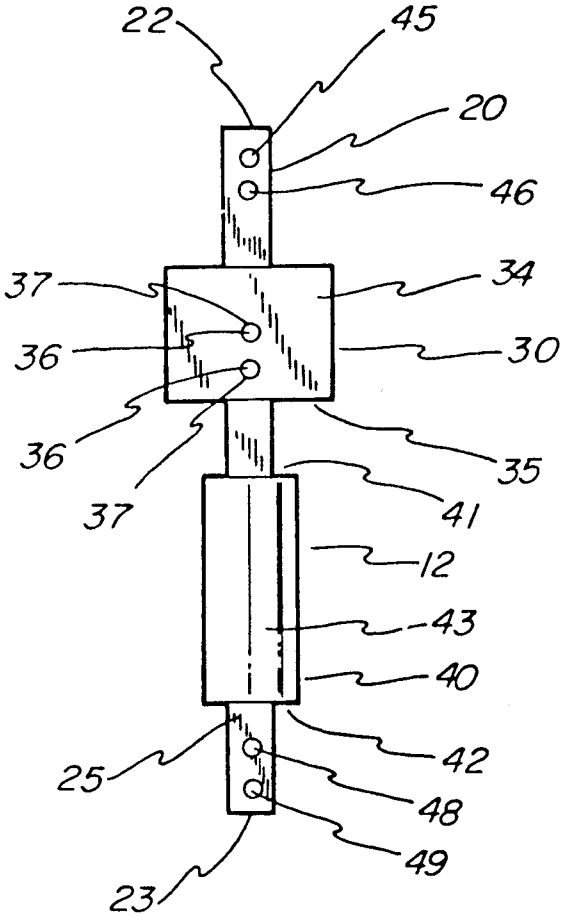
FIG. 3. is a rear elevational view of the first tool component of the invention.
Figure 2:
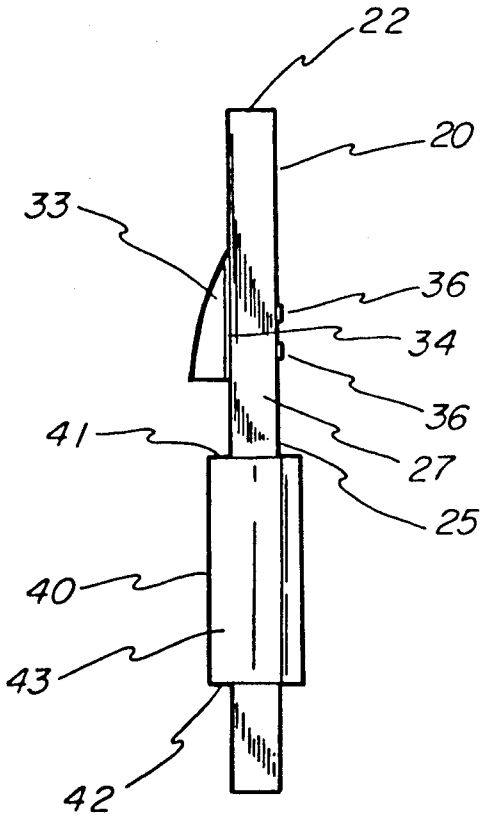
FIG. 2 is a side elevational view of the first tool component of the invention.

FIGS. 2 and 3 disclose that wedge-shaped member 30 is secured to base member 20 by wedge attachment means 36 which preferably are in the form of recessed screws. The presence of a pair of such attachment means 36 prevents the accidental rotation of wedge-shaped member 30 relative to base member 20. In addition to providing the desired stability for the wedge-shaped member 30, the presence of the two wedge attachment means permits their removal through the holes or wedge apertures 37 in base member 20 and wedge-shaped member 30 such that the rotation of wedge-shaped member 30 through 180' and the subsequent securing of the wedge-shaped member 30 to the member 20 in an inverted position can be accomplished. In addition, the apertures 45 and 46 may be used as orifice for attachment of wedge-shaped members 30 so that the wedge shape may be presented at the topmost position on the base. Such a mounting position may be desirable for user's who do not wish to interconnect tools 12 and 14.

In addition to wedge-shaped member 30, the base member 20 has attached thereto a first cylindrical member 40 in the form of a handle, which is preferably padded just as is wedge-shaped member 30. This cylindrical member 40 is preferably wrapped about the base member intermediate the wedge-shaped member 30 and the bottom 23 of base member 20. The first cylindrical member 40 has a planar top 41 and planar bottom 42 and an outer sidewall surface 43.

As can be seen in FIGS. 1 and 3, base member 20 preferably includes two sets of apertures, base top apertures 45 and 46 respectively and base bottom apertures 48 and 49 respectively. In the preferred embodiment of the invention wherein base member 20 is of a rectilinear cross section, these apertures 45, 46, 48 and 49 extend through the base member from the front 24 to the rear 25. The first set of apertures 45 and 46 are located intermediate the top and the wedge-shaped member and the second set of apertures 48 and 49 are located intermediate the bottom and the cylindrical member.

The second tool component 14 is comprised of a second base member 60 substantially the same as base member 20, in that the second base member 60 comprises a top 61, a bottom 62, a front 63, a rear 64, and a pair of side walls 65 and 66 respectively. The overall length of the second base member is preferably greater than or equal to the length of base member 20. Located intermediate the top 61 and bottom 62 of the second base member is a second cylindrical member 70. The configuration of this second cylindrical member is preferably similar to that of the first cylindrical member 40 in that the second cylindrical member 70 also comprises a planar top 71, a planar bottom 72 and an outer sidewall surface 73. As can be appreciated from the drawing figures, preferably the length of this second cylindrical member 70 is greater than the length of the first cylindrical member 40. As is the case with the first cylindrical member 40, the second cylindrical member 70 is also preferably padded. The respective base members 20 and 60 may be fabricated from a suitable metal, plastic, or even wood. Similarly, the covering for the wedge-shaped member 30, the first cylindrical member 40 and the second cylindrical member 70 may be either plastic, leather, or other suitable composition. It will also be appreciated from FIG. 2 that the wedge rear face is positioned forward of the base member 20.

Figure 4:
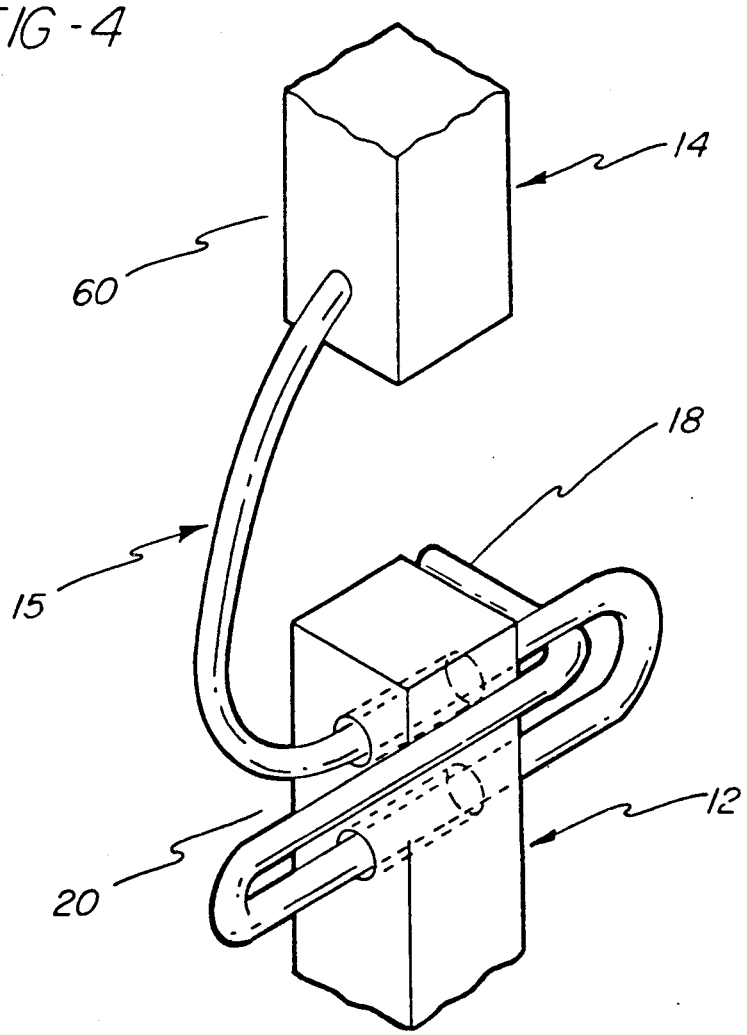
FIG. 4 is a perspective view on a greatly enlarged scale disclosing the method of securing together the first and second tool components of the invention.

The first tool component 12 is secured to the second tool component 14 when desired by the cord 15 which is secured at the attachment means aperture 75 of the second base member 60. The presence of the two sets of apertures 45, 46 and 48, 49 permit the adjustability of the distance between the first and second tool components as well as selectivity with respect to the orientation of the wedge-shaped member, the first cylindrical member and the second cylindrical member. As can be seen in FIG. 4, the tip 18 of cord 15 is passed through one and then the other of a given set of the base apertures. Preferably this passage occurs from the front to the rear and thence from the rear to the front of the base member 20 or vice versa. Following the return passage of the cord 15 through the base member, the tip 18 is passed beneath the loop which is formed such that when the loop is pulled taut against base member 20 the cord, especially with respect to tip 18, is held in frictional engagement to define a fixed link of cord between base member 60 and 20.

In actual use, the device of this invention may utilize the first tool component 12 in conjunction with or separate from the second tool component 14. Additionally, the wedge-shaped member 30 may be used alone, or in combination with the second cylindrical member 70. Still further, the first cylindrical member maybe used alone or in connection with second cylindrical member 70. Finally, the second cylindrical member 70 may be used alone even when the first and second tool components 12 and 14 respectively are joined together.

To utilize the wedge-shaped member alone, simply pull the padded portion of the wedge towards the region of tenderness, disregarding the supposed locations of trigger points. Similarly the wedge-shaped member may be utilized in aesthetic position by placing it beneath the tender area of a muscle utilizing its handle 40 and leaning or rolling the body along the wedge until pressure which relieves the pain or discomfort is experienced. Furthermore, utilization of the wedge-shaped member while standing may be effectuated by positioning the wedge against the body with support for the rear 25 of base member 20 being provided by a door frame for example. Once again the body is leaned or rolled relative to the wedge until relief is experienced. To increase the pressure associated with the wedge-shaped member in this position, an individual may lean harder against the door frame, pull with the handle 40, and/or push against the opposite side of the frame. Still further, in the recline position the wedge-shaped member may be positioned beneath the painful or discomforted muscle. The body may then be positioned upon the wedge-shaped member until relief is experienced.

Still further, the padded wedge 30 shape on a handle mount is an ideal configuration for therapist assisted (ischemic compression) pressure therapy, either singly or in combination with the second tool 14. This facilitates decongestive compression therapy, unlike "acupressure therapy" where focal spasms are relieved with focal pressure or electrical or sonic counter-irritants. Instead, graduated pressures of a larger surface area is possible with the graduated slope of the wedge or cylindrical member. This distinction is important since "finger pressure", acupressure, and trigger point specific therapies are, by nature, point specific, whereas the generalized contacts of the embodiments of this invention serve to more directly influence generalized intramuscular edema. This therapy concept has been identified by the inventor of this device, and has been termed "decongestive compression", to distinguish it from the more point specific, neuromuscular/trigger point arts of pressure application.

The second cylindrical member 70 or in some cases the first cylindrical member 40 may be used alone to effectively apply pressure to tender or tensed muscles particularly at the base of the neck and at the tops of the shoulders. Additionally, the second cylindrical member 70 may be used in combination with the wedge-shaped member 30 when the first and second tool components 12 and 14 are secured to one another to apply pressure to the muscles of the neck, around and between the shoulder blades, and to the joints of the arms and legs.

When applying pressure, the amount of pressure applied should extend through the sensations of tenderness and up to the point of pain, but not into the pain level. As tenderness and pain begin to subside, an individual may slightly increase the pressure and hold it for 5-10 seconds. Then the degree of pressure should slowly be decreased. Pressure which is too quickly applied or too quickly released can cause pain and additional tensing of muscles as well as resulting in less effective treatment of pain and muscle discomfort. Further, the composition of the padded surfaces may permit the tools to be heated either intrinsicly or extrinsicly to enable heated decongestive compression. This heat application encourages muscle relaxation and vascular dilation and, therefore, may yield better results in some cases. Methods of heating may include immersion in hot water, microwaving, electric heating elements, and battery packs.

Figure 6:
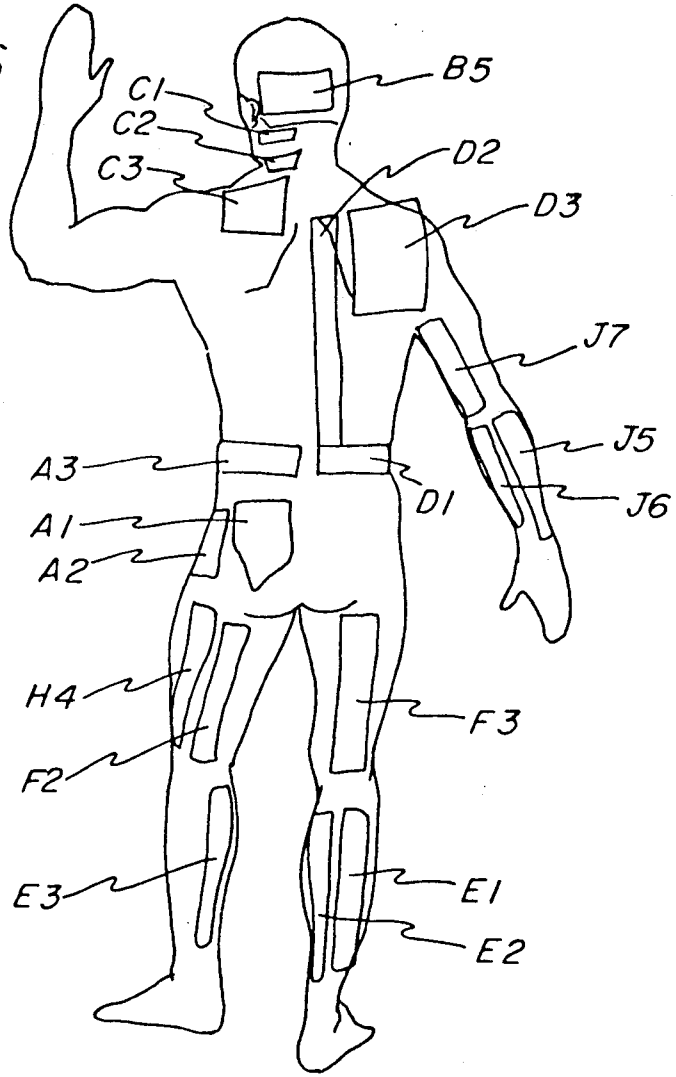
FIGS. 5 and 6 are schematic illustrations of the human body with recommendations for the method of treating pain in each designated area in accordance with the structure of the invention.
Figure 5:
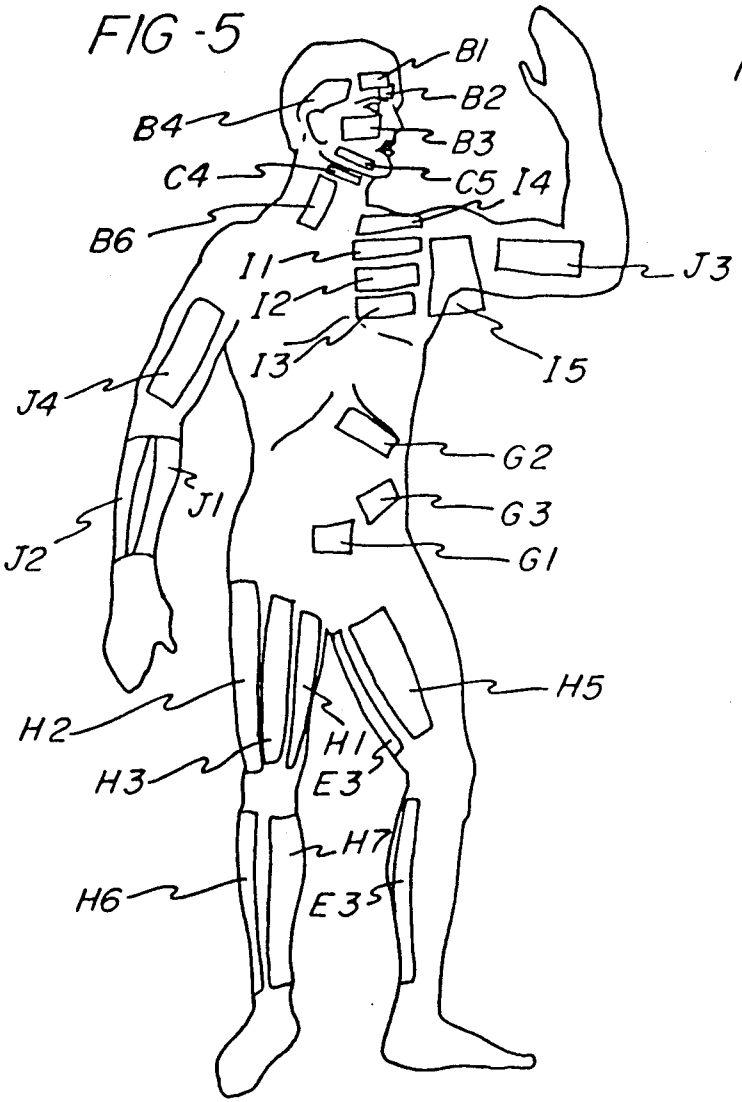

FIGS. 5 and 6 disclose schematic representations of the human body with various areas of pain treatable using the present invention set forth in accordance with the following directory. Each capitalized letter corresponds to a particular type of pain. Each number associated with the capitalized letters corresponds to a specific region where treatment for that type of pain may be effected. With respect to each pain area, the listing of a "capital W" indicates that the wedge-shaped member may be used, the listing of the "Wr" indicates that the wedge-shaped member 30 should be used but that the second tool component 14 should be connected to the bottom 23 of base member 20; the designation "Rw" means that the second cylindrical member 70 should be utilized but that the second tool component 14 should be connected to the top of the first tool component 12; and the designation "Wh" indicates that the padded handle 40 of the first tool component should be utilized, and that the first tool component should be connected to the second tool component 14 at the bottom 23 of base member 20. The presence of more than one designation indicates that, depending on the individual, alternate methodologies of treatment may encounter success.

The following are step-by-step instructions to help extinguish a variety of all-too-common chronic pains. Common pains (capital letters) are treated by relieving tender points within each of the areas listed (numbers).

Recommended tools for each pain area are listed according to the following codes:

W—Wedge (leaning into or pressing with wedge alone)
Wr—Wedge contact point but connected to the roll
Rw—Roll contact point but connected to the wedge
Wh—Padded handle of wedge tool connected to roll tool A. Lower Back Pain

A-1 in the hip pocket area (W, Wr)
A-2 at the side of the pelvis, above the hips (W, Rw, Wr)
A-3 around the belt area (W, Rw)

B. Headaches

B-1 on the forehead and around the eyes (Wr, W)
B-2 at the bridge of the nose (Wr, W)
B-3 around the cheek bones (Wr, W)
B-4 around the ears (Wr)
B-5 at the back of the head (Wr)
B-6 along the side of the neck (esp. if dizzy) (Wh)

C. Jaw Pains (With or Without Headaches)

C-1 at the upper part of the back of the neck (Wh)
C-2 between the shoulders (Rw)
C-3 over the tops of the shoulders (Rw, Wr)
C-4 beneath the jaw (W)
C-5 above the jaw (W)

D. Shoulder Pain

D-1 from the belt line (W, Rw)
D-2 systematically up from the belt line along the spine (W, Wr)
D-3 around the shoulder blade (W, Rw)

E. Lower Legs

E-1 along the back/center of leg (knee to ankle) (Wh, Wr, Rw)
E-2 along the back/inside of leg (knee to ankle) (Wh, Wr, Rw)
E-3 along the back/outside of leg (knee to ankle) (Wh, Wr, Rw)

F. Upper Legs

F-1 along the back/inside of thigh (knee to groin) (Wh, Wr, Rw)
F-2 along the back/outside of thigh (knee to groin) (Wh, Wr, Rw)
F-3 along the back/center of thigh (knee to groin) (Wh, Wr, Rw)

G. Menstrual Pains

G-1 above the pelvic brim (W)
G-2 beneath the ribs (W)
G-3 around the front side of the hip bones (W, Rw, Wr)
G-4 (if backache) do A1-A3

H. Painful Knees

H-1 along front/inside of thigh (knee to groin) (Wh, Wr, Rw)

H-2 along front/outside of thigh (knee to groin) (Wh, Wr, Rw)

H-3 along front/center of thigh (knee to groin) (Wh, Wr, Rw)

H-4 along outside of thigh (knee to groin) (Wh, Wr, Rw)

H-5 along inside of thigh (knee to groin) (Wh, Wr, Rw)

H-6 along front/outside of leg (knee to ankle) (Wh, Wr, Rw)

H-7 along front/inside of leg (knee to ankle) (Wh, Wr, Rw)

I. Chest Pains

I-1 beneath the collar bone (W)

I-2 immediately beneath I-1 (W)

I-3 immediately beneath I-2 (2)

I-4 above the collar bone (W)

I-5 all around the armpit (W, Wr, Rw, Wh)

J. Arm Pains

J-1 along back of forearm (thumb to elbow) (Wr, Rw, Wh)

J-2 along back of forearm (pinky to elbow) (Wr, Rw, Wh)

J-3 along inside of arm (elbow to shoulder) (Wr, Rw, Wh)

J-4 along outside of arm (elbow to shoulder) (Wr, Rw, Wh)

J-5 along front of forearm (pinky to elbow) (Wr, Rw, Wh)

J-6 along front of forearm (thumb to elbow) (Wr, Rw, Wh)

J-7 along back of arm (elbow to shoulder) (Wr, Rw, Wh)

The invention disclosed herein stimulates intramuscular fluid pressure in a manner similar to Shiatzu therapy, with resultant muscle spindle desensitivity and concomitant relaxation. Additionally, this device generates enough gentle pressure to stretch lock actin and myosin filaments apart to terminate run away contracture activity. Furthermore, the device generates enough pressure to force trapped intramuscular fluid from the intrafascicular and tendinous noncontractile hiding places towards positions of high metabolic activity and good circulation and alters Starling's equilibrium to favor fluid displacement into circulation.

Still further, the gentle pressure delivered by this device will passively assist in the return of venous flow toward the heart and thereby decrease local venous hydrostatic pressures. Additionally, the device operates like an ischemic compression technique to treat myofascial trigger points as well as pain which is not relieved by treatment of a specific trigger point.

Additionally, this device or its coverings may be immersible in boiling water, or microwavable, and can couple the benefits of heat with decongestive compression therapy.

Additionally, the device of this invention is convenient and easy to use for a non-medical professional and is relatively inexpensive and simple to fabricate. Finally, through the utilization of this particular invention, it is possible to alleviate the pain stemming from tension, acidosis, toxicosis, or edema in only a few seconds.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An intramuscular fluid pressure stimulation device, said device comprising a base member, said base member having a top and a bottom, a wedge-shaped member having a front face, and a bottom surface, said wedge-shaped member attached to said base member intermediate said top and bottom, said base member and wedge-shaped member comprising a first tool component, and a second tool component, said second tool component comprising a second base member, said second base member having a top, a bottom and a cylindrical member wrapped about said second base member intermediate the second base member top and bottom, said second base member cylindrical member having an outer sidewall surface, said first tool component attached to said second tool component by a cord.

2. The device according to claim 1 which includes a cylindrical member, said cylindrical member wrapped about said base member intermediate said wedge-shaped member and said bottom, said cylindrical member having an outer sidewall surface.

3. The device according to claim 2 wherein said wedge-shaped member is detachably secured to said base member.

4. The device according to claim 1, wherein said first tool component is detachably secured to said second tool component.

5. The device according to claim 1 which includes a first set of apertures extending through said base member, said first set of apertures located intermediate said top and said wedge-shaped member.

6. The device according to claim 5 which includes a second set of apertures through said base member, said second set of apertures located intermediate said bottom and said cylindrical member.

7. The device according to claim 1 wherein said wedge rear face is positioned forward of said base member.

8. The device according to claim 1 wherein said base member has a front wall, a rear wall and a pair of side walls.

9. The device according to claim 8 wherein said device has a set of apertures extending through said base member from said front wall to said rear wall.

10. The device according to claim 1 wherein the second tool component cylindrical member is of a length equal to or greater than that of the first tool component cylindrical member.

11. The device according to claim 1 wherein said cord permits the adjustability of the distance between the first tool component and second tool component.

12. An intramuscular fluid pressure stimulation device, said device comprising a first tool component comprising a base member, said base member having a top, a bottom, and a cylindrical member, said cylindrical member wrapped about said base member intermediate said top and bottom, said cylindrical member having an outer sidewall surface, said first tool component also comprising a wedge-shaped member having a front face, a rear face, and a bottom surface, said wedge-shaped member attached to said base member intermediate said top and said cylindrical member, and a second tool component comprising a second base member, said second base member having a top, a bottom and a cylindrical member wrapped about said second base member intermediate the second base member top and bottom, said second base member cylindrical member having an outer sidewall surface, said first tool component attached to said second tool component by a cord.

13. The device according to claim 12 wherein said wedge-shaped member is detachably secured to said first tool component base member.

14. The device according to claim 12 wherein said wedge rear face is positioned forward of said first tool component base member.

15. The device according to claim 12 wherein said first and second tool components base members each has a front wall, a rear wall and a pair of side walls.

16. The device according to claim 12 wherein the second tool component cylindrical member is of a length greater than that of the first tool component cylindrical member.

17. An intramuscular fluid pressure stimulation device, said device comprising, a first tool component comprising a base member, said base member having a top, a bottom and a cylindrical member, said cylindrical member wrapped about said base member intermediate said top and bottom, said cylindrical member having an outer sidewall surface, said first tool component also comprising a wedge-shaped member having a front face, a rear face, and a bottom surface, said wedge-shaped member attached to said base member intermediate said top and said cylindrical member, and a second tool component comprising a second base member, said second base member having a top, a bottom, and a cylindrical member wrapped about said second base member intermediate the second base member top and bottom, said second base member cylindrical member having an outer sidewall surface, said first tool component secured to said second tool component by a cord.

18. The device according to claim 17 wherein said first and second tool components base members each has a front wall, a rear wall, and a pair of side walls, said first tool component base member having at least a set of apertures extending therethrough from said front wall to said rear wall.

19. The device according to claim 17 wherein the second tool component member is of a length greater than that of the first tool component cylindrical member.

20. An intramuscular fluid pressure stimulation device, said device comprising a base member, said base member having a top and a bottom, a wedge-shaped member having a front face, and a bottom surface, said wedge-shaped member attached to said base member intermediate said top and bottom, a first set of apertures extending through said base member, said first set of apertures located intermediate said top and said wedge-shaped member, and a second set of apertures extending through said base member, said second set of apertures located intermediate said bottom and said wedge-shaped member.

* * * * *